US007213423B2

(12) United States Patent
Lim et al.

(10) Patent No.: US 7,213,423 B2
(45) Date of Patent: May 8, 2007

(54) WASHING MACHINE

(75) Inventors: Hee Tae Lim, Puchon-shi (KR); Gwan Ryong Park, Seoul (KR); Jae Won Chang, Kunpo-shi (KR); Kyeong Hwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 393 days.

(21) Appl. No.: 10/243,671

(22) Filed: Sep. 16, 2002

(65) Prior Publication Data

US 2004/0031294 A1 Feb. 19, 2004

(30) Foreign Application Priority Data

Aug. 13, 2002 (KR) ..... 10-2002-0047800

(51) Int. Cl.
*D06F 29/00* (2006.01)
*D06F 13/08* (2006.01)

(52) U.S. Cl. ..... 68/23.2; 68/23.6; 68/133

(58) Field of Classification Search ..... 68/23.2, 68/23.6, 53, 133–134
See application file for complete search history.

(56) References Cited

U.S. PATENT DOCUMENTS

| | | | | |
|---|---|---|---|---|
| 2,416,611 | A * | 2/1947 | Castricone | 68/53 |
| 2,636,374 | A * | 4/1953 | Castricone | 68/134 |
| 2,929,234 | A * | 3/1960 | Castricone | 68/17 A |
| 3,760,950 | A * | 9/1973 | Hine | 210/373 |
| 4,328,600 | A * | 5/1982 | Bochan | 8/159 |
| 5,775,137 | A * | 7/1998 | Yanagisawa | 68/133 |
| 6,115,863 | A * | 9/2000 | Mason et al. | 8/159 |

* cited by examiner

*Primary Examiner*—Joseph L. Perrin
(74) *Attorney, Agent, or Firm*—Ked & Associates, LLP

(57) ABSTRACT

A washing machine capable of minimizing tangle and damage of the laundry is disclosed. The washing machine includes: a wash shaft installed perpendicularly at a lower center of an inner tub, and rotated by a rotational force transferred from a motor; a wash plate orbiting about a rotational center of the wash shaft to form a stream of water; and a movement converting unit for converting a rotational movement of the wash shaft to a orbiting movement of the wash plate.

24 Claims, 9 Drawing Sheets

WASHING MACHINE

This application claims the benefit of the Korean Application No. 2002-47800 filed on Aug. 13, 2002, which is hereby incorporated by reference.

BACKGROUND OF THE INVENTION

1. Field of the Invention

The present invention relates to a washing machine, and more particularly, to a washing machine capable of minimizing tangle and damage of the laundry and decreasing usage of the wash water.

2. Discussion of the Prior Art

Generally, washing machine is an apparatus in which energy such as impact or the like is applied to the laundry so as to remove contaminants. According to the applying method of the energy, the washing machines are classified into the pulsator washing machine, drum washing machine and agitator washing machine. In the drum washing machine, the laundry is dropped and impacted by the rotation of the drum, to be washed. In the pulsator washing machine and the agitator washing machine, the rotation of the pulsator or agitator coupled to the washing shaft perpendicular installed at the inner tub allows the laundry to impact, and the wash action of detergent is added thereto, so that wash is performed. In other words, the aforementioned washing machines utilize a method in which impact is applied to the laundry by a mechanical method to perform the washing.

Referring to FIG. 1, a conventional pulsator washing machine will be now described as follows.

An outer tub 3 for containing wash water is installed inside a case 1 of the washing machine, an inner tub 5 is installed inside the outer tub 3 and is impacted, and a pulsator 7 is installed inside the inner tub 5. A motor 9 for rotating the inner tub 5 and the pulsator 7 is installed below the outer tub 3.

In more detail, a dehydration shaft 15 is coupled with the inner tub 5, a wash shaft 13 that can be selectively coupled with the dehydration shaft 15 is installed inside the hydration shaft 15, and the pulsator 7 is rotatably installed at a predetermined portion of the wash shaft 13.

The rotational force of the motor 9 is selectively transferred to the inner tub 5 and the pulsator 7 by a clutch assembly 11. Also, the wash shaft 13 and the dehydration shaft 15 are selectively serration-coupled by a solenoid 11*a*.

Referring to FIG. 1, operation of the conventional pulsator washing machine will be described as follows.

First, wash cycle is described as follows. Laundry is loaded into the interior of the inner tub 5, and the washing machine is driven, so that wash water is supplied into the inner tub 5. After the completion of the wash water supply, in a state where the laundry is dipped in the wash water, the pulsator 7 is rotated in the forward or backward direction to wash the laundry. In other words, the rotational force of the motor 9 is transferred to the pulsator 7 through the wash shaft 13, and washing is performed by water stream generated by the stirring of the pulsator 7 and friction between the pulsator 7 and the laundry.

Next, dehydration cycle is described. In the dehydration cycle, the wash shaft 13 and the dehydration shaft 15 are rotated as if they are one body by the operation of the solenoid 11*a*. In other words, the inner tub 5 and the pulsator 7 are rotated at a high speed together to perform the dehydration.

As aforementioned, the conventional washing machine carries out the washing by stirring the pulsator to rub the laundry in a state where the laundry is dipped in the wash water, or by water stream.

Accordingly, the conventional washing machine is difficult to avoid tangling or damage of the laundry. Also, since the conventional washing machine carries out the washing in a state where the laundry is dipped in the wash water, the amount of the wash water and the amount of the detergent increase, and a total washing time is lengthened due to the increase in the supply and drain time of the wash water not directly related with the washing time.

SUMMARY OF THE INVENTION

Accordingly, the present invention is directed to a washing machine that substantially obviates one or more problems due to limitations and disadvantages of the related art.

An object of the present invention is to provide a washing machine capable of minimizing tangle and damage of the laundry.

Another object of the present invention is to provide a washing machine capable of saving usage amount of the wash water.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing machine includes: a wash shaft installed perpendicularly at a lower center of an inner tub, and rotated by a rotational force transferred from a motor; a wash plate orbiting about a rotational center of the wash shaft to form a stream of water; and a movement converting unit for converting a rotational movement of the wash shaft to a orbiting movement of the wash plate.

Preferably, the movement converting unit includes a base having an eccentric shaft formed in an upper portion thereof, the eccentric shaft being coupled to the wash plate and a lower portion of the base being coupled to the wash shaft.

Preferably, the movement converting unit further includes a counterweight for correcting imbalance in the weights of the base and the wash plate.

Alternatively, a pumping passage is installed at one side of the inner tub, and a pumping means rotating according to the rotation of the wash shaft to pump the wash water of the inner tub to the pumping passage is installed at the lower side of the base. Preferably, the pumping means is a plurality of blades formed from the center of the inner tub along an outer circumferential direction.

Preferably, the movement converting unit further includes a wash plate adapter of which one side is coupled to the eccentric shaft and the other side is coupled to the wash plate.

Preferably, a bearing is installed between the eccentric shaft and the wash plate adapter, and the bearing has a construction capable of transferring the rotational force in one side direction. Preferably, a sealer is installed below the bearing.

Alternatively, a self-rotation preventing member for preventing the rotation of the wash plate is installed between the wash plate and the inner tub.

Preferably, a protruded portion is formed below the eccentric shaft, and a cap is installed below the protruded portion. The cap is divided into at least two caps for smooth assembling.

Preferably, a plurality of guide members formed from the center of the eccentric shaft along an outer circumferential direction are installed on the upper surface of the wash plate. The guide members may be made in the form of a spiral type.

Also, a plurality of guide members which form a concentric circle with respect to the center of the eccentric shaft may be installed on the upper surface of the wash plate. Preferably, the guide members have a section shape of waves.

Preferably, the upper surface of the wash plate has a height difference along the rotational direction. The vertical section of the wash plate may be made to have a construction in which a tangent slope with respect to the surface of the wash plate increases as it radially travels from the central portion to the circumferential portion.

Preferably, a textile caught preventing ring is installed at a lower circumference of said wash plate such that laundry is not caught between the lower side of the inner tub and the wash plate.

Preferably, the counterweight is at least partially inserted in the wash plate so as to match the height in the center of gravity of the counterweight with the height in the center of gravities of the eccentric shaft and the wash plate.

Preferably, a plurality of protruded portions are formed at the inner wall of the inner tub, so that the laundry is effectively washed between the wash plate and the protruded portions of the inner tub due to the orbiting movement of the wash plate.

In another aspect of the invention, the eccentric shaft is installed oblique by a predetermined angle.

Preferably, a flexible member is installed between the wash plate and the lower portion of the inner tub.

Preferably, the lower portion of the inner tub is made to have a sphere shape.

In another aspect of the invention, the movement converting unit includes a base of which one side of the lower portion is coupled with the wash shaft, and circumference is directly coupled with the wash plate with a bearing as a medium.

In another aspect of the present invention, a washing machine includes: a wash shaft installed perpendicularly at a lower center of an inner tub, and rotating by a rotational force transferred from a motor; and a wash plate directly coupled to the wash shaft, wherein the rotational center of the wash shaft and the rotational center of the wash plate are arranged so as not to accord with each other, and thus the rotational movement of the wash shaft is converted into the orbiting movement of the wash plate.

According to the aforementioned invention, it becomes possible to minimize tangle and damage of the laundry and save usage amount of the wash water.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
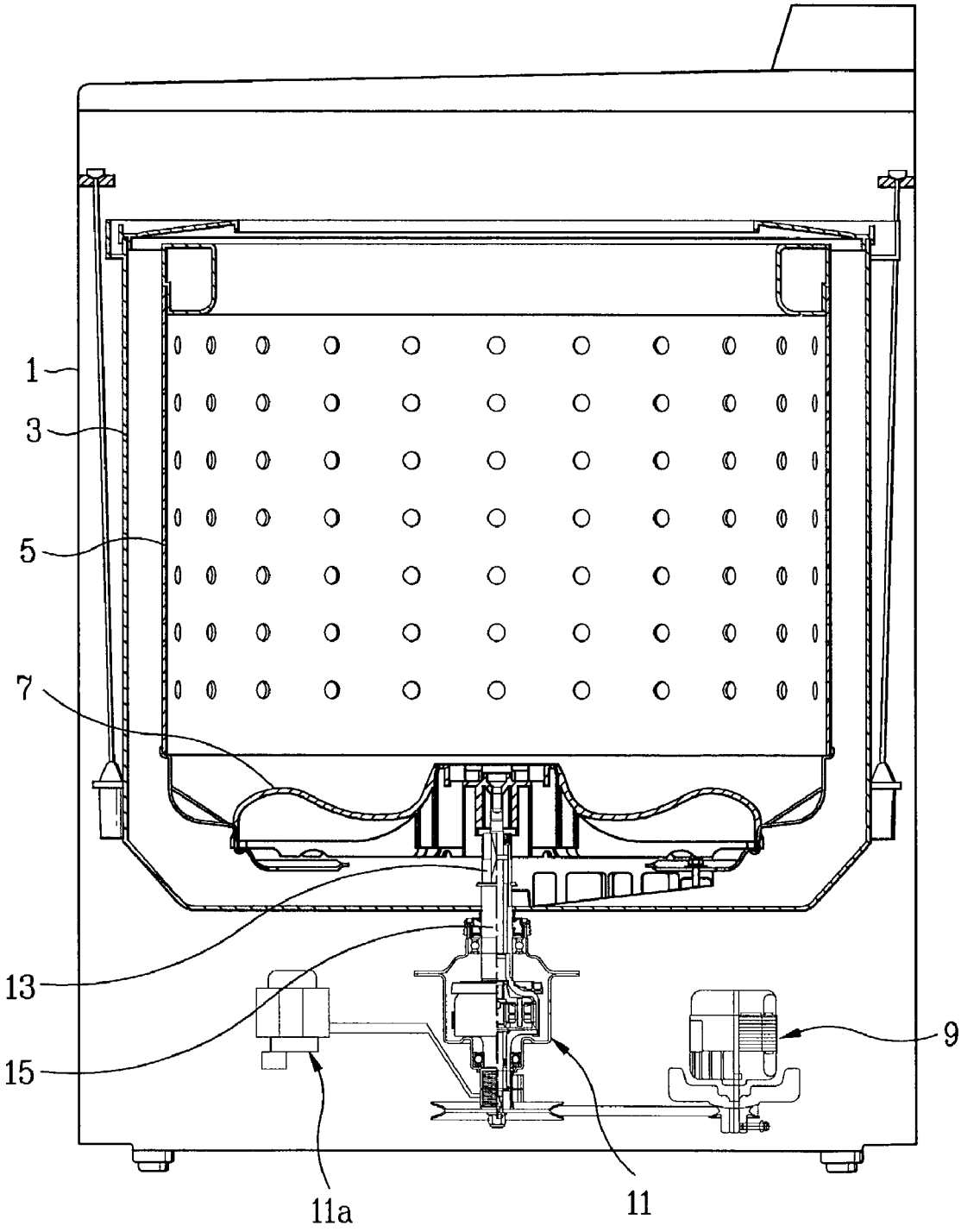
FIG. 1 Related Art
FIG. 1 is a side view schematically showing a conventional washing machine.
Figure 2:
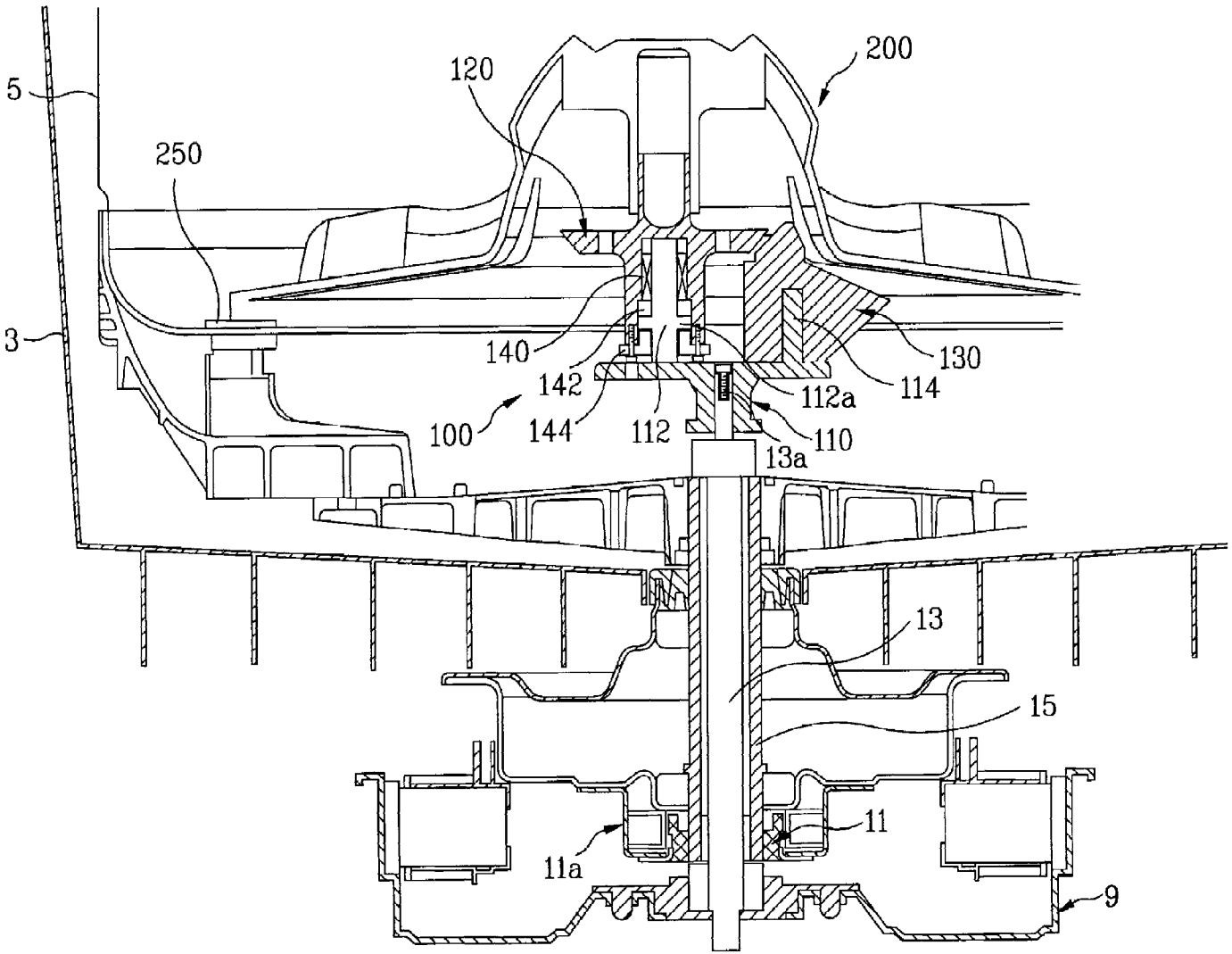
FIG. 2 is a sectional view of a washing machine according to an embodiment of the present invention.
Figure 3:
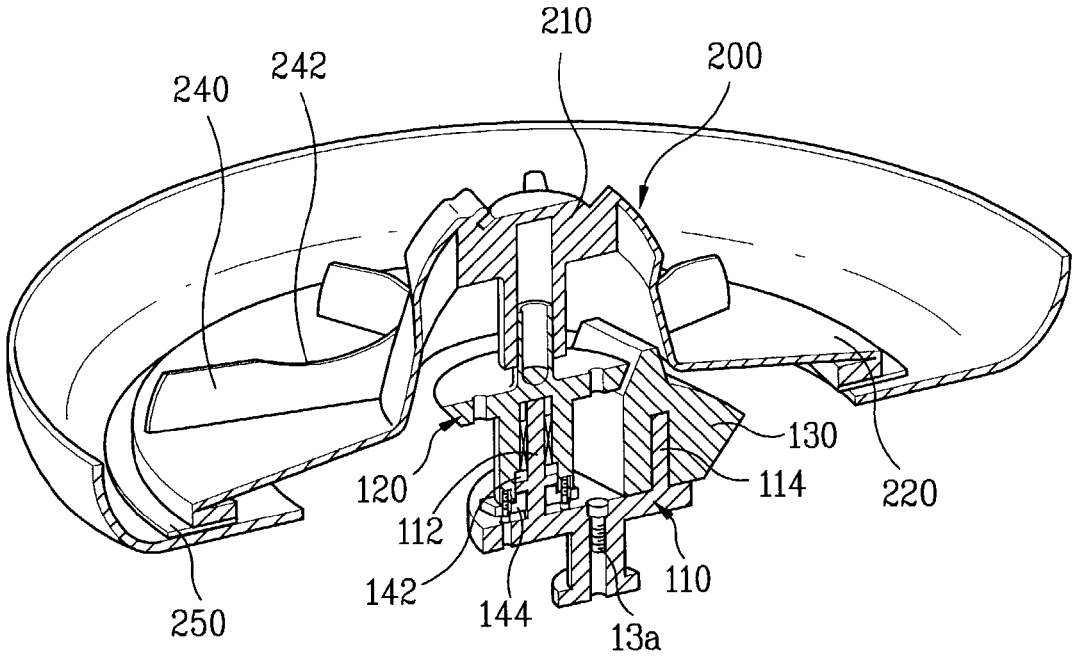
FIG. 3 is a perspective view of main portions of FIG. 2.

Referring to FIGS. 2 and 3, a washing machine according to one embodiment of the present invention will be described as follows.

The washing machine of the present invention is the same in the general construction as that of the conventional art. In other words, the washing machine of the present invention also includes an outer tub 3, an inner tub 5, a clutch assembly 11, a solenoid 11*a*, a motor 9 and the like. However, the washing machine of the present invention further includes a movement converting unit 100 for converting the simple rotational movement of the motor 9 (or wash shaft 13) to a whirl movement.

In other words, water stream in the conventional washing machine is generated by the simple rotational movement of the pulsator coupled to the wash shaft. However, in the present invention, it is only necessary that a wash plate for generating water stream is coupled to the wash shaft with the movement converting unit as a medium, and it gyrates to effectively transfer physical force such as beating, bending and stretching the laundry, into the laundry.

In more detail, a hollow dehydration shaft 15 is coupled to the inner tub 5, and a wash shaft 13 that can be selectively coupled to the dehydration shaft 15 is installed inside the dehydration shaft 15. FIG. 2 shows that the wash shaft 13 is directly coupled to the motor 9 by using the outer rotor type motor 9, but it is apparent that the present invention is not limited thereto. In other words, it is naturally possible to indirectly transfer the rotational force of the motor 9 using a pulley not directly coupling the wash shaft 13 to the motor 9.

Meanwhile, the wash shaft 13 is protruded toward the inner center of the inner tub 5, and the rotation of the wash shaft 13 is transferred to the wash plate 200 with the movement converting unit 100 as a medium. In other words, a base 110 having an eccentric shaft 112 is coupled to the wash shaft 13, and the wash plate 200 is coupled to the eccentric shaft 112. At this time, in order to correct eccentric weights of the eccentric shaft 112 and the wash plate 200 that are eccentric with respect to the wash shaft 13, it is preferable that a counterweight 130 is installed at an opposite side to the eccentric shaft 112.

Respective elements and coupling relations are in more detail described as follows.

The wash shaft 13 is coupled integrally with the base 110, and preferably they are serration-coupled.

Meanwhile, the wash plate 200 is directly coupled to the eccentric shaft 112, but it is preferable that a wash plate adaptor 120 is interposed between the eccentric shaft 112 of the base 110 and the wash plate 200. This is because the use of the wash plate adaptor 120 enables to enhance the relative movement of the wash plate 200 and the base 100, and the assembling capability of the products.

Also, it is preferable that a bearing 140 is installed between the wash plate adaptor 120 and the eccentric shaft 112 such that the wash plate 200 and the wash plate adaptor 120 can freely perform relative movement with respect to the eccentric shaft 112.

At this time, below the bearing 140 is installed a sealer 142 for preventing the wash water from being in contact with the bearing 140 during the washing.

Also, the bearing 140 may be made in a structure in which the rotational force is transferred in one side direction. In this case, the wash plate 200 is rotatable only when the wash shaft 13 is rotated in one side direction, and the wash plate 200 cannot be rotatable when the wash shaft 13 is rotated in a reverse direction. By doing so, it is possible to allow the wash plate 200 to perform the rotation movement in one side direction and to perform both the orbiting movement and the rotation movement in the other side direction according to the rotational direction of the wash shaft 13.

In more detail, in order for the wash plate 200 to deviate from the normal location to upward or downward direction, a protruded portion 112*a* having a relatively large diameter is installed below the eccentric shaft 112. The sealer 142 is installed over the protruded portion 112*a*, and the wash plate adaptor 120 and an assemblable additional cap 144 are installed. For the smooth assembling, the cap 144 is preferably divided into at least two. A thrust bearing (not shown) may be additionally installed over and/or below the protruded portion 112*a* so as to lower the friction between the protruded portion 112*a* and other member(s).

Meanwhile, in order to assemble the cap 144 at the lower portion of the wash plate adaptor 120, it is preferable to form an assembling hole 116 at a circumference of the base 110. Of course, the circumference of the base 110 may be partially cut instead of the assembling hole 116.

Also, in order to fix the base 110 on the wash shaft 13, it is preferable to form an assembling hole 122*a* at a circumference of the wash plate adaptor 120 or partially cut the base 110.

Next, an assembling procedure of the wash shaft 13, the base 110 and the wash plate adaptor 120 is described as follows.

First, the bearing 140 and the sealer 142 are assembled to the wash plate adaptor 120. After that, the wash plate adaptor 120 is assembled to the base 110 and finally the cap 144 is assembled. At this time, as aforementioned, since the cap 14 is divided into at least two, one is arbitrarily assembled and then a bolt 118 is coupled through the assembling hole 116 of the base 110. The coupled cap is rotated by an angle of about 180°, and then the remaining cap is assembled in the same way.

Once the base 110 and the wash plate adaptor 120 are assembled, the base 110 is coupled to the wash shaft 13. The base 110 is coupled to the wash shaft 13 by a bolt 13*a*. At this time, a tool for coupling the bolt enters into the assembling hole 122*a* formed at the wash plate adaptor 120.

Meanwhile, as aforementioned, in order to correct the eccentric weight of the eccentric shaft 112 and the wash plate 200, the counterweight 130 is preferably installed at the opposite location to the eccentric shaft 112. The counterweight 130 should balance with the eccentric weight of the eccentric shaft 112 and the wash plate 200. Also, it is preferable that the height of the gravity center of the eccentric shaft 112 and the wash plate 200 is approximately similar to the height of the gravity center of the counterweight 130 so as to balance with the height of the gravity center of the eccentric shaft and the wash plate.

The counterweight 130 may be formed integrally with the wash plate 200, the wash plate adaptor 120 or the base 110, but it is more preferable that the counterweight 130 is separately installed at the base 110 for the convenience of the assembling. In other words, it is preferable that the counterweight 130 is installed to be slightly inserted into an inner space of the wash plate 200 at a location of 180° from the eccentric shaft 112 round the wash shaft 13.

Meanwhile, it is preferable that a caught preventing ring 250 is installed at the circumference of the wash plate 200 such that the laundry is caught between the wash plate 200 and the inner tub 5. It is more preferable that the caught preventing ring 250 is made of member having a low friction characteristic. The caught preventing ring 250 is preferably installed at a lower circumference of the wash plate 200. Alternatively, it is also possible to fabricate the inner lower surface of the inner tub 5 in a proper shape so as to minimize a gap between the wash plate 200 and the lower portion of the inner tub 5 according to the movement of the wash plate 200.

Figure 4:
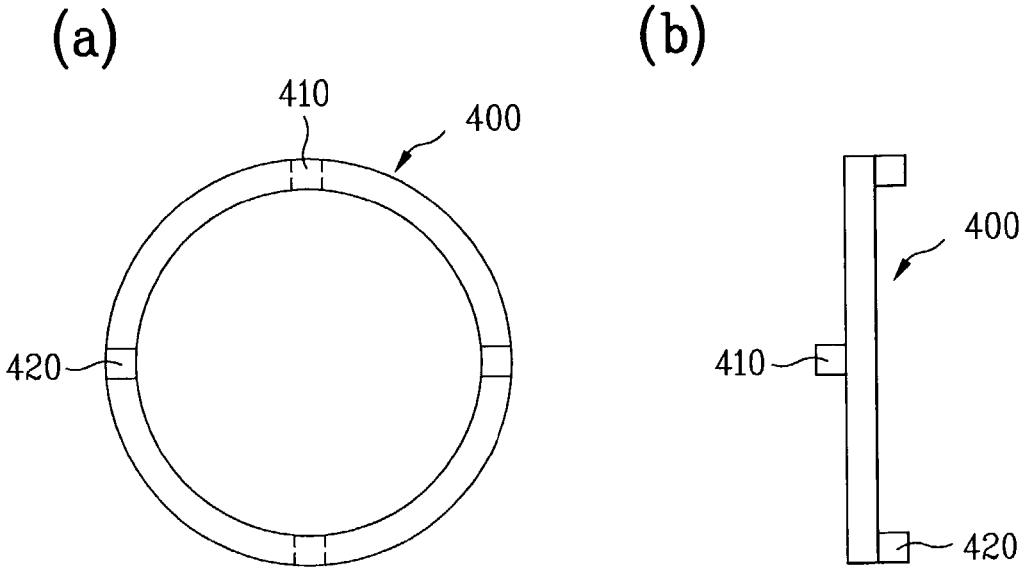
FIGS. 4A and 4B are plan view and side view of a self-rotation preventing member of a washing machine according to the present invention.

Meanwhile, as shown in FIG. 4, a self-rotation preventing member 400 is installed between the wash plate 200 and the inner tub 5, thereby capable of preventing the rotational movement of the wash plate 200 with respect to the center of the eccentric shaft 112 when the wash plate orbits.

The self-rotation preventing member 400 is operated in a similar principle to Oldham coupling. In other words, the self-rotation preventing member 400 has a protruded vertical guide 410 and a protruded horizontal guide 420. The vertical guide 410 is inserted in a linear groove (not shown) formed on the upper surface of the inner tub 5, and the horizontal guide 420 is inserted in a linear groove (not shown) formed at the lower surface of the wash plate 200. By doing so, the self-preventing member 400 can be moved only in the upward and downward direction with respect to the inner tub 5, and the wash plate 200 can be moved only in the left and right direction, so that the wash plate 200 does not self-rotate but freely orbits.

Meanwhile, a plurality of protruded portions (not shown) are formed at the inner wall of the inner tub 5, so that the laundry is effectively washed between the wash plate 200 and the protruded portions of the inner tub 5 due to the orbiting movement of the wash plate 200.

Figure 5:
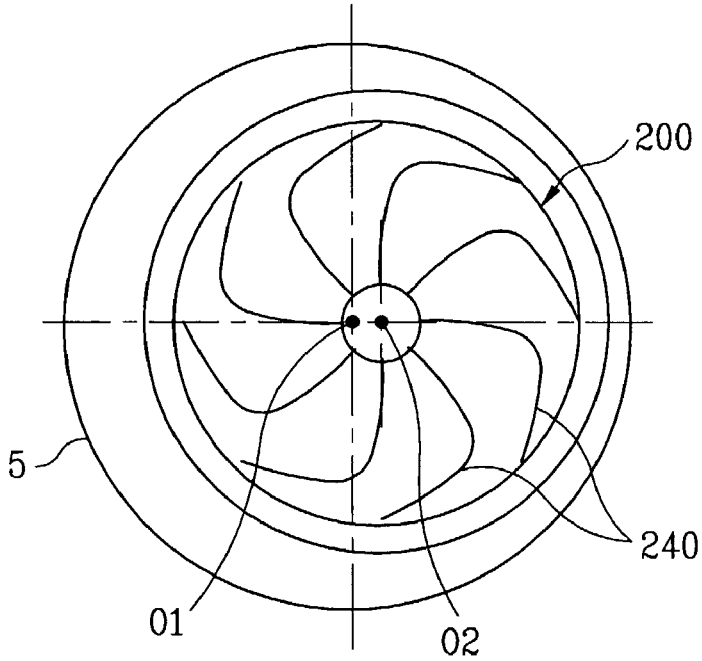
FIG. 5 is a plan view of an exemplary construction of the washing plate of FIG. 2.
Figure 6:
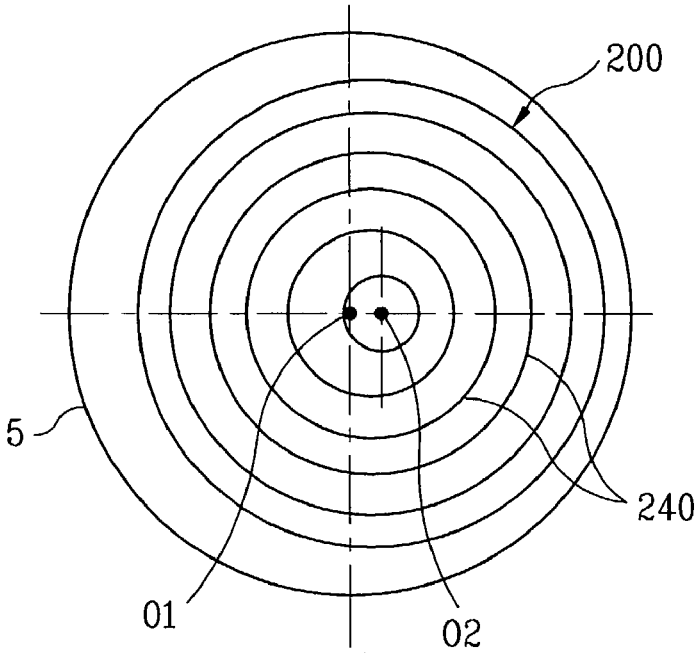
FIG. 6 is a plan view of another exemplary construction of the washing plate of FIG. 2.

Next, the wash plate 200 is in detail described with reference to FIGS. 3, 5 and 6. In the drawings, reference numeral 01 represents a rotational center of the wash shaft, and numeral 02 represents a rotational center of the eccentric shaft, e.g., wash plate.

The wash plate 200 includes a boss part 210 placed at the center and coupled with the wash plate adaptor 120, and a horizontal part 220 that is approximately flat and is formed extending toward the circumferential direction from the boss part 210. A plurality of guide members 240 are installed at the horizontal part 220 of the wash plate 200. As shown in FIG. 3, the guide members 240 are made in an upward protruded shape, and are radially installed in the circumferential direction from the center 02 of the eccentric shaft. And, as shown in FIG. 5, the plurality of radial-shaped guide members 240 may be installed in a spiral type. By doing so, it is possible to push or pull the laundry toward the center of the wash plate 200 or the circumferential portion by the forward and backward rotation of the wash shaft 13. Also, as shown in FIG. 6, the guide members are made in a circle type, and they may be arranged to form a plurality of concentric circles about the center 02 of the eccentric shaft.

Meanwhile, it is preferable that the respective guide members 240 are varied in height as it travels from the central portion to the circumferential portion. For instance, by forming concave portions 242 at selected portions of the wash plate 200, it is preferable to make the wash plate 200 in the form of waves. By doing so, when the laundry is radially moved, the wash plate serves as a washboard.

Figure 7:
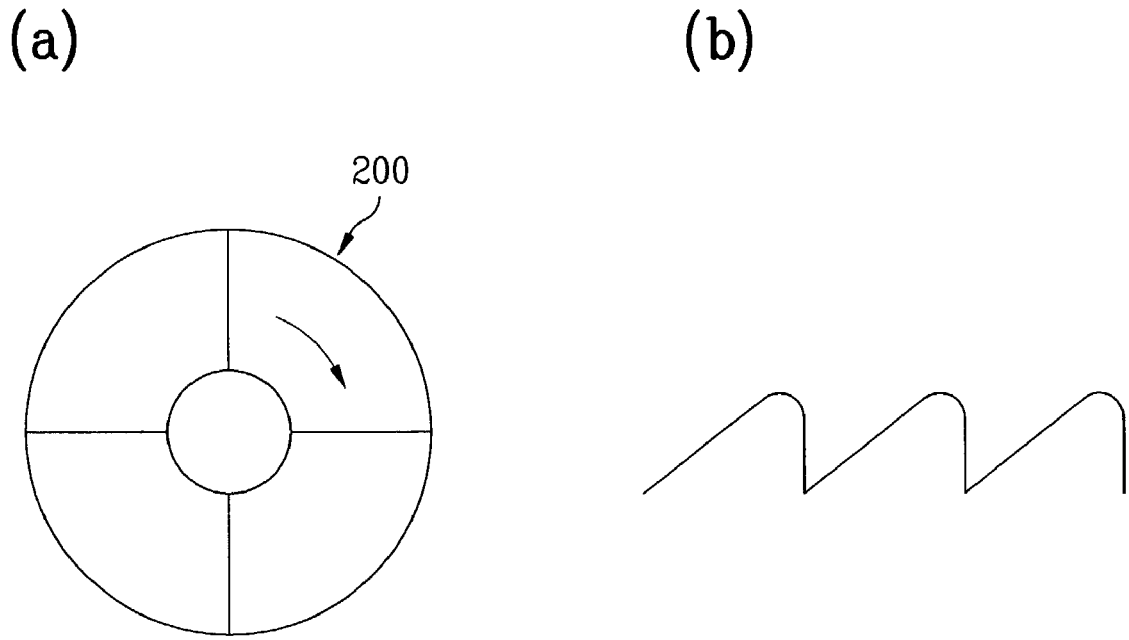
FIGS. 7A and 7B are plan view and disassembled view of another exemplary construction of the washing plate of FIG. 2.

Meanwhile, as shown in FIG. 7, it may be intended that the upper surface of the wash plate has a height difference in the rotational direction. For instance, it is preferable that the upper surface of the wash plate 200 is made in the form of a sawtooth. By doing so, it is possible to induce vibration and fluctuation of the laundry in the upward and downward direction by the horizontal orbiting movement of the wash plate 200 and the rotational movement of the wash plate 200 with respect to the eccentric shaft 112.

Figure 8:
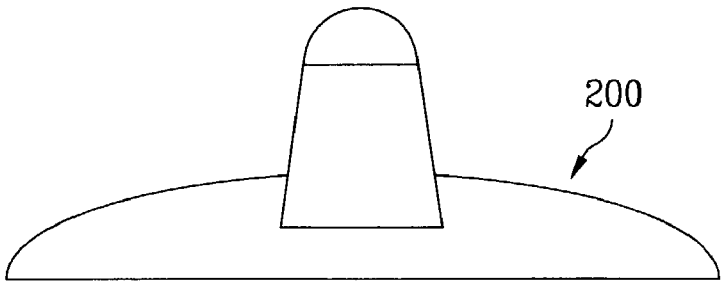
FIG. 8 is a side view of another exemplary construction of the washing plate of FIG. 2.

Also, as shown in FIG. 8, it is preferable that the vertical section passing through the center axis of the wash plate, i.e., the eccentric shaft 112 is made to have a construction in which a tangent slope with respect to the surface of the wash plate increases as it radially travels from the central portion to the circumferential portion, thereby allowing the circumferential portion to beat the laundry more positively.

Next, an operation of the washing machine according to the present invention is described as follows.

First, wash cycle is described as follows. As the wash shaft 13 is rotated by the rotation of the motor 9, the base 110, the eccentric shaft 112 and the counterweight 130 all integrally coupled with the wash shaft 13 are simultaneously rotated with the wash shaft 13 as a rotational shaft. At this time, the wash plate 200 is freely rotatable with respect to the eccentric shaft 112 by the bearing 140. Accordingly, the wash plate 200 is orbited about the rotational center of the wash shaft 13, and at the same time the wash plate 200 gradually rotates while sliding with the eccentric shaft 112 occurs due to the movement of the laundry.

Meanwhile, it is preferable that the wash shaft 13 repeats forward and backward rotation so as to prevent tangle of the laundry. As the wash shaft 13 is rotated in one side direction, the wash plate 200 orbits and at the same time is rotated in the orbiting direction with respect to the eccentric shaft 112. And, as the wash shaft 13 is rotated in the opposite direction, the direction of the orbiting movement of the wash plate 200 is directly changed. As the orbiting movement continues, the direction of the rotational movement of the wash plate 200 is further changed into the direction of the orbiting movement of the wash plate 200.

Meanwhile, the laundry is continuously moved from the center portion of the inner tub 5 to the side portion of the inner tub 5 regardless of the rotational direction of the wash shaft 13. Also, by the shape of the upper surface of the wash plate 200, the laundry vibrates in the upward and downward direction to be beaten, and is also compressed, bent and stretched between the side surface of the wash plate 200 and the inner sidewall of the inner tub 5, thereby performing the washing. Imbalance of the eccentric shaft 112 and the wash plate 200 with respect to the wash shaft 13 during the washing is offset by the action of the counterweight 130, so that vibration decreases.

In the dehydration cycle, as the solenoid is driven, the wash shaft 13 and the dehydration shaft 15 are integrally coupled with each other. Once the motor 9 is rotated, the wash shaft 13, the dehydration shaft 15, the wash plate 200 and the counterweight are integrally rotated, so that the dehydration is carried out.

As described above, according to the present invention, by the orbiting movement and the rotational movement of the wash plate 200, the laundry in the inner tub 5 is continuously beaten, bent and stretched, so that the washing is carried out nearly without tangle and damage of the laundry. Also, the laundry is beaten by the guide members formed on the wash plate 200, and radial fluctuation proceeding from the central portion of the lower portion of the inner tub 5 is continuously generated, so that tangle and damage of the laundry is remarkably reduced.

Figure 9:
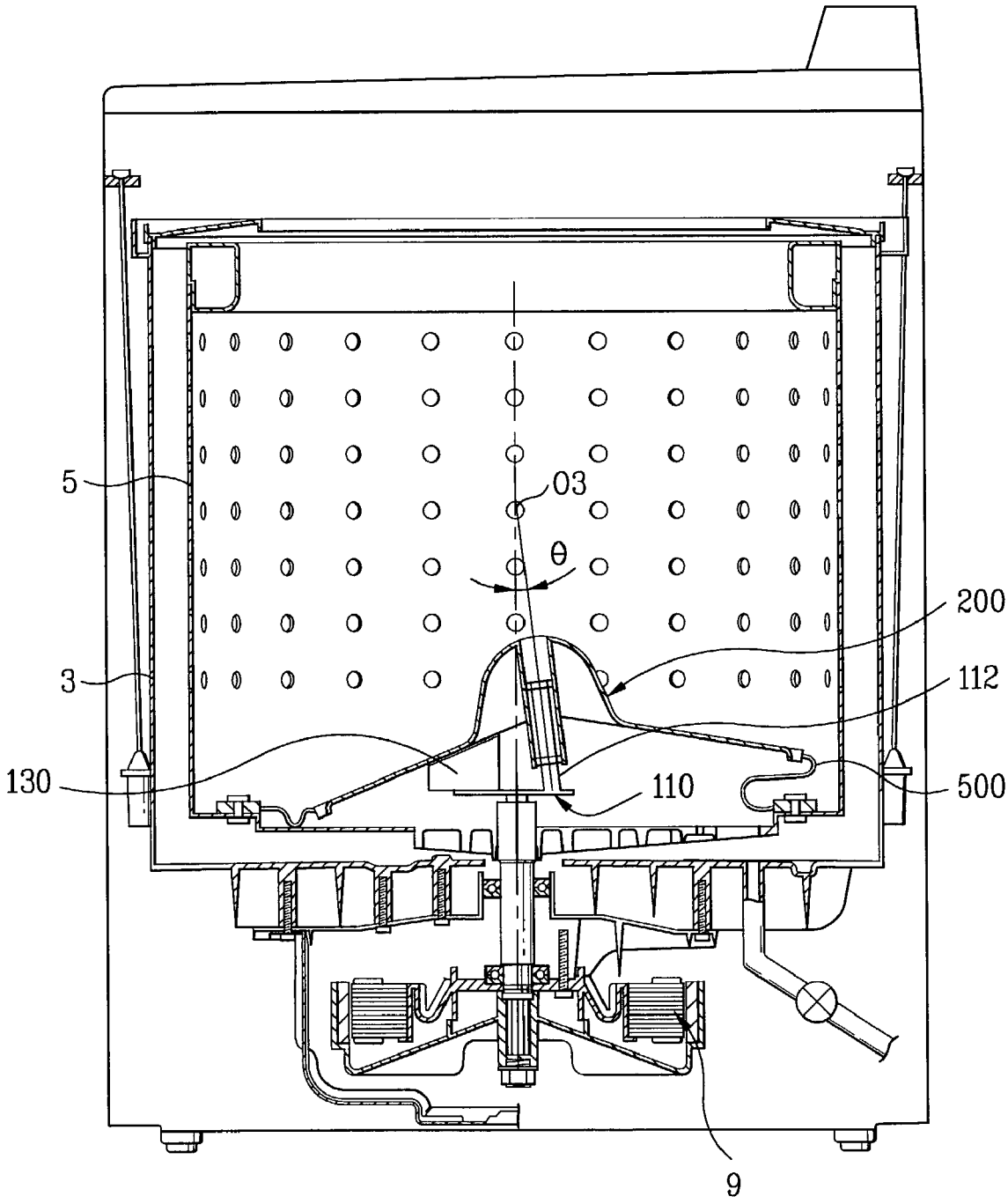
FIG. 9 is a sectional view of a washing machine according to another embodiment of the present invention.

Referring to FIG. 9, a washing machine according to another embodiment of the present invention is described.

The present embodiment is the same in the whole construction as the previous embodiment, but the present embodiment has an eccentric shaft 112 obliquely installed by a predetermined angle (θ) such that an arbitrary point of the wash plate 200 is movable up and down.

In more detail, on a plane where the wash shaft 13 and the eccentric shaft 112 pass, an upper portion of the eccentric shaft 112 is sloped with respect to a lower portion of the eccentric shaft 112 toward a vertical direction passes through the wash shaft 113 or an opposite direction to the vertical direction, or toward a direction perforating the plane. By doing so, the wash plate 200 orbits about the wash shaft 13 during the washing and at the same time an arbitrary point on the surface of the wash plate 200 draws a trajectory of a vertical direction.

Meanwhile, a flexible member 500 is installed between the wash plate 200 and the lower portion of the inner tub 5, thereby preventing the laundry from being caught between the wash plate 200 and the lower portion of the inner tub 5.

Figure 10:
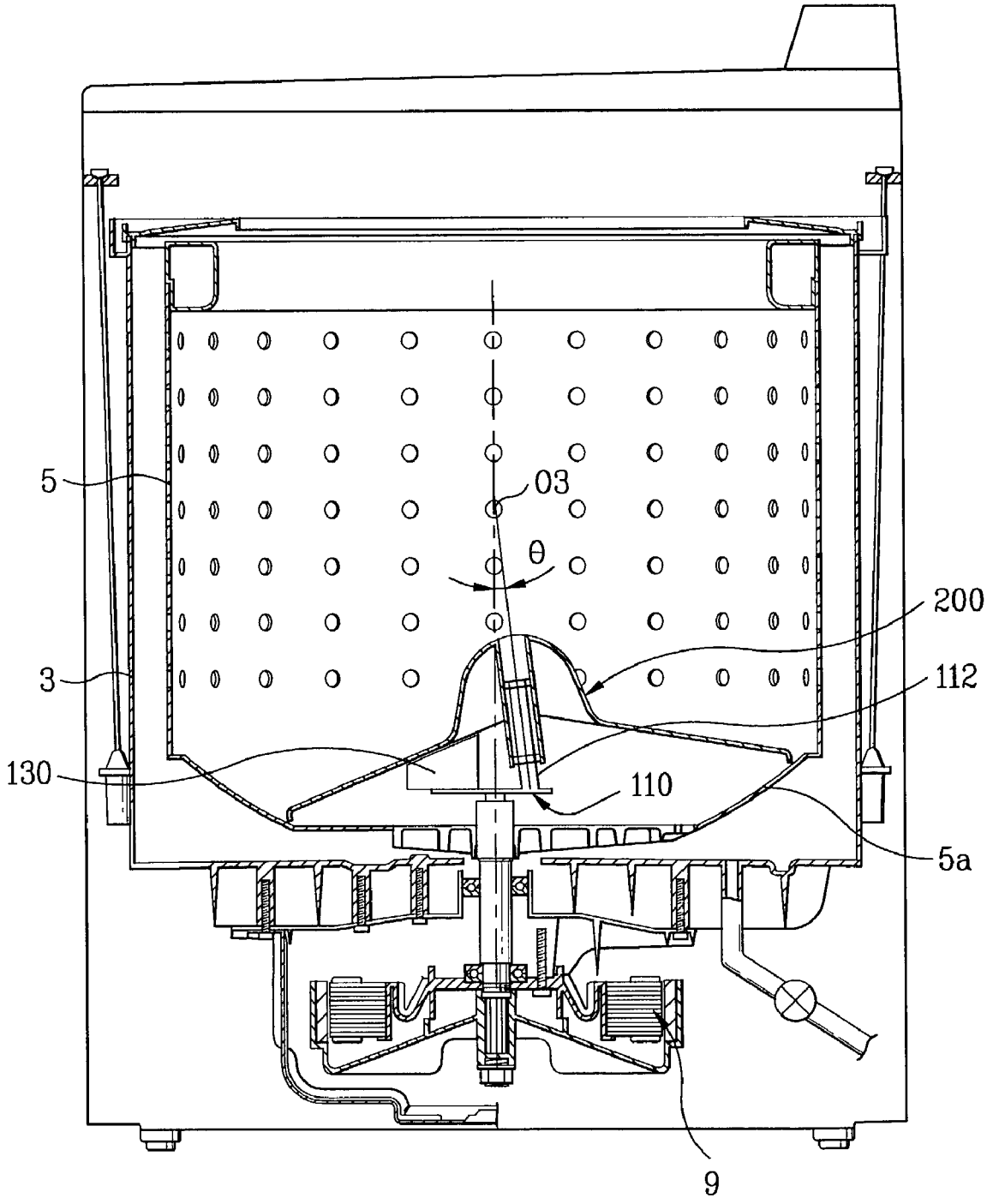
FIG. 10 is a sectional view showing a modification of FIG. 9.

Meanwhile, as shown in FIG. 10, it is preferable that the lower portion of the inner tub 5 has a partial surface shape of sphere. Since the wash plate 200 is moved round a central point 03 of the rotation where an extending line of the wash shaft meets with an extending line of the eccentric shaft, the lower portion **5*a* of the inner tub 5 preferably has a sphere shape with the central point 03 as the center of the sphere. By doing so, since the wash plate 200 is moved along the surface of the sphere shape during the washing, it can be prevented that the laundry is caught between the wash plate 200 and the bottom surface of the inner tub 5**.

Figure 11:
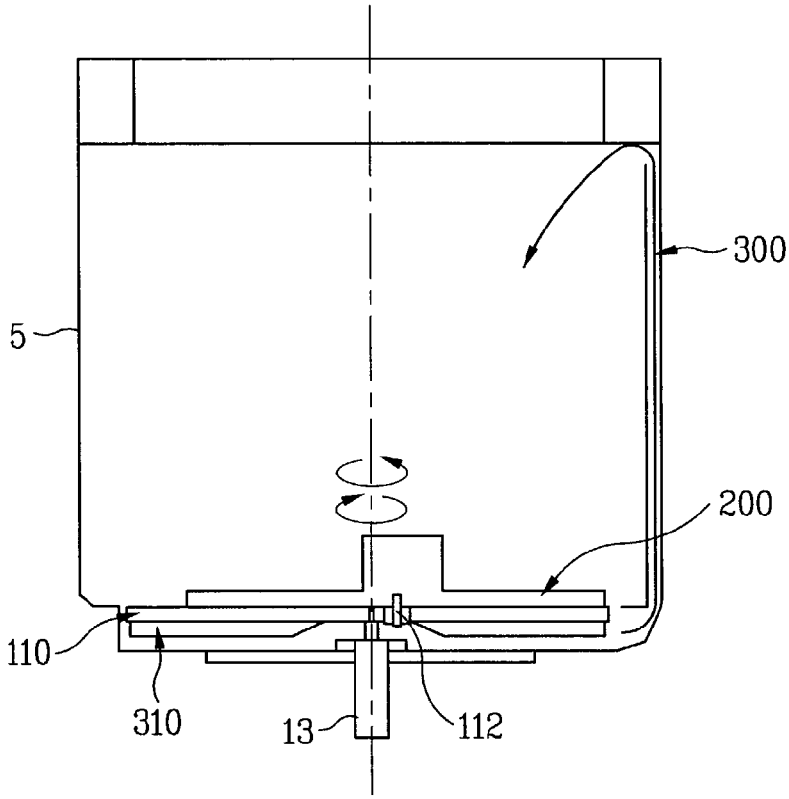
FIG. 11 is a sectional view of a washing machine according to another embodiment of the present invention.
Figure 12:
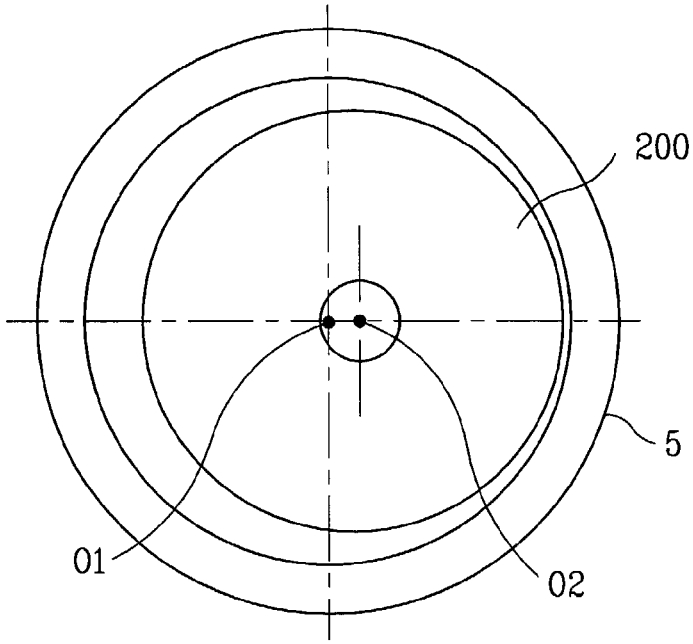
FIG. 12 is a plan view of FIG. 11.

Referring to FIGS. 11 and 12, a washing machine according to a further embodiment of the present invention is described.

The present embodiment is also the same in the whole construction as the previous embodiments, but the present embodiment is discriminated in that a pumping passage 300 and a pumping means 310 are additively installed to pump the wash water using the pumping means 310 during the washing and circulate the pumped wash water through the pumping passage 300, thereby injecting the wash water from the upper portion of the inner tub 5 onto the laundry.

In more detail, the pumping passage 300 is formed at one side of the inner tub 5. The pumping means 310 is installed below a base 110. Preferably, the pumping means 310 is comprised of a plurality of blades.

While FIG. 11 shows that the base 110 is made to have the same size as the inner diameter of the inner tub 5 and the pumping means 310 is installed below the base 110, the present invention is not restricted thereto. In other words, any member may be used as the pumping means 310 if it is rotatable as the wash shaft 13 is rotated.

According to the present embodiment, the wash water is continuously pumped from the lower side of the inner tub 5 to the upper side of the inner tub 5 and the pumped wash water is injected onto the laundry during the wash cycle, thereby capable of saving the usage amount of the wash water.

Figure 13:
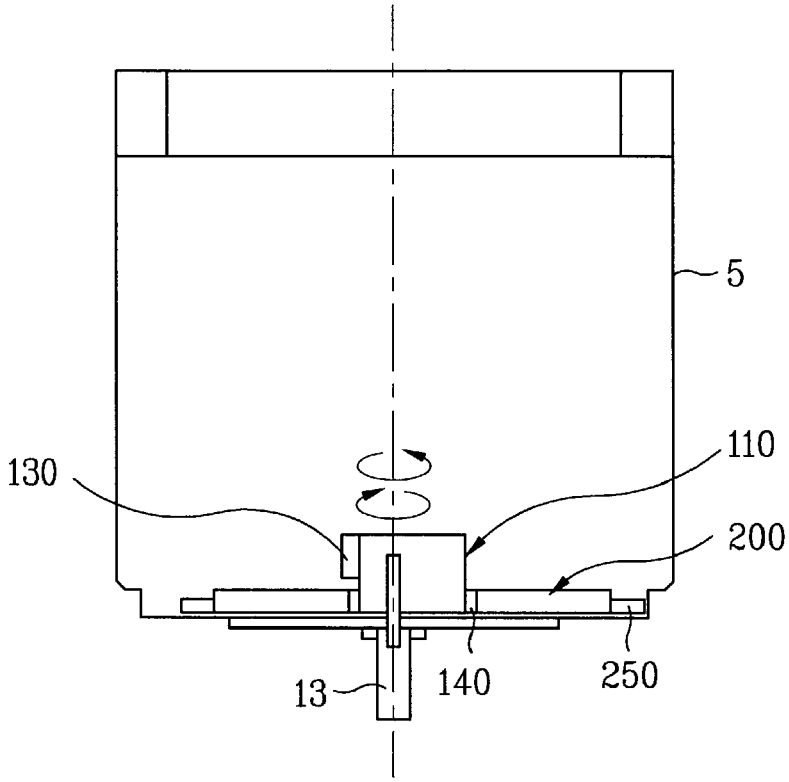
FIG. 13 is a sectional view of a washing machine according to another embodiment of the present invention.
Figure 14:
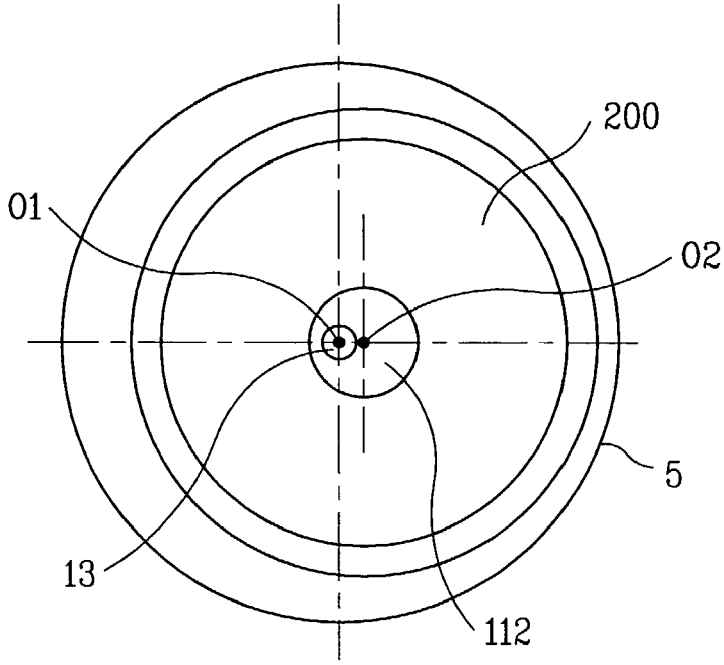
FIG. 14 is a plan view of FIG. 12.

Referring to FIGS. 13 and 14, a washing machine according to still another embodiment of the present invention is described.

The present embodiment is the same in principle as the previous embodiments, but is discriminated in that the eccentric shaft 112 is not separately formed at the base 110 but the base 110 holds the role of the eccentric shaft with the original role thereof so as to simplify the whole structure. In other words, the base 110 is formed larger relative to the wash shaft 13, and the base 110 is coupled to the rotational shaft such that the center of the base 110 does not accord with the center of the wash shaft 13. Also, on the circumference of the base 110 is coupled the washing plate 200 with the bearing 140 as a medium. By doing so, the center of gravity of the wash shaft 13 does not accord with the center of gravity of the base 110. Accordingly, the counterweight 130 is installed at one side of the base 110. Also, it is preferable that a caught preventing ring 250 is installed outside the base 110. Since the operation of the present embodiment is the same as those of the previous embodiments, detail description thereof is omitted.

Meanwhile, the aforementioned embodiment shows and describes that the wash plate is coupled to the wash shaft with the movement converting unit as a medium. However, the present invention is not restricted thereto. In other words, it is also possible to directly couple the wash plate to the wash shaft. At this time, the center of gravity of the wash shaft is arranged not to accord with the center of gravity of the wash plate such that the wash plate orbits about the wash shaft.

As described previously, the washing machines according to the present invention have the following effects.

First, a simple rotational movement of motor (or wash shaft) is converted into a orbiting movement by a movement converting unit and thus omnibus impact including horizontal and vertical directional impact is applied to the laundry, thereby remarkably reducing tangle and damage of the laundry. Also, use of the movement converting unit basically excludes occurrence structure of friction or impact, so that low noise is possible.

Secondly, since the movement converting unit may be made in the form of a module, its assembling is simplified. Also, since the movement converting unit can be equipped without changing the construction of the conventional washing machine, it is possible to apply the washing method of the present invention to the conventional washing machine.

Thirdly, according to the present invention, the laundry is not dipped in the wash water and is washed by the recirculation and injection of the wash water, so that usage amount of the wash water is reduced.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A washing machine, comprising:

a wash shaft installed perpendicularly at a lower center of a rotatable inner tub, and rotated by a rotational force transferred from a motor;

a wash plate orbiting about a rotational center of the wash shaft to form a stream of water; and a movement converting unit for converting a rotational movement of the wash shaft to an orbiting movement of the wash plate, wherein said movement converting unit comprises:

a base having an eccentric shaft formed in an upper portion thereof, said eccentric shaft being coupled to said wash plate and a lower portion of said base being coupled to said wash shaft, wherein the eccentric shaft is fixed relative to the wash shaft, and wherein a rotational axis of the eccentric shaft is parallel to and offset from a rotational axis of the wash shaft; and a counterweight mounted on the base such that the counterweight substantially corrects for an imbalance in the weights of the base and the wash plate.

2. The washing machine of claim 1, wherein a pumping passage is installed at one side of the inner tub, and further comprising pumping means for pumping wash water of the inner tub to the pumping passage, wherein said pumping means is installed at the lower side of the base.

3. The washing machine of claim 2, wherein said pumping means comprises a plurality of blades that extend from the center of said inner tub toward an outer circumference.

4. The washing machine according to claim 1, wherein said movement converting unit further comprises a wash plate adapter of which one side is coupled to the eccentric shaft and the other side is coupled to the wash plate.

5. The washing machine of claim 4, wherein a bearing is installed between the eccentric shaft and the wash plate adapter.

6. The washing machine of claim 5, wherein the bearing has a construction capable of transferring the rotational force in one side direction.

7. The washing machine of claim 4, wherein a self-rotation preventing member for preventing the rotation of the wash plate relative to the inner tub is installed between the wash plate and the inner tub.

8. The washing machine of claim 1, wherein a plurality of guide members are formed from the center of the eccentric shaft toward an outer circumferential direction are installed on the upper surface of the wash plate.

9. The washing machine of claim 8, wherein the guide members are made in the form of a spiral.

10. The washing machine of claim 1, wherein the upper surface of the wash plate has a height difference along the rotational direction.

11. The washing machine of claim 10, where the wash plate has a saw tooth profile.

12. The washing machine of claim 1, wherein the vertical section of the wash plate is made to have a construction in which a tangent slope with respect to the surface of the wash plate increases as it radially travels from the central portion to the circumferential portion.

13. The washing machine of claim 1, wherein a textile caught preventing ring is installed at a lower circumference of said wash plate such that laundry is not caught between the lower side of the inner tub and said wash plate.

14. The washing machine of claim 1, wherein the counterweight is at least partially inserted in said wash plate so as to match the height in the center of gravity of the counterweight with the height in the center of gravities of the eccentric shaft and the wash plate.

15. The washing machine according to claim 1, wherein a circumference of the base is directly coupled with the wash plate with a bearing as a medium.

16. The washing machine of claim 1, wherein the counter weight is fixed relative to the eccentric shaft.

17. The washing machine of claim 1, wherein the wash plate comprises a boss part formed in a center and a horizontal part formed at a periphery, and wherein the boss part receives the wash plate adapter.

18. The washing machine of claim 1, wherein the base is a single piece, and the upper portion of the base is formed on a side opposite of the single piece base from the lower portion of the single piece base.

19. A washing machine, comprising:

a motor;

a rotatable wash shaft coupled to the motor;

a rotatable inner tub, wherein the wash shaft is installed perpendicularly at a lower center of the inner tub;

a base having a central portion and a peripheral portion, wherein the central portion is coupled to the wash shaft, wherein an eccentric shaft is fixed on the peripheral portion of the base, and wherein a rotational axis of the eccentric shaft is parallel to a rotational axis of the wash shaft;

a wash plate coupled to the eccentric shaft such that rotation of the wash shaft causes eccentric rotation of the wash plate; and a counterweight coupled to one of the base and the wash plate and configured to correct an imbalance in the weights of the base and the wash plate.

20. The washing machine of claim 19, wherein the counterweight is fixed on the peripheral portion of the base at a location about 180° with respect to the eccentric shaft.

21. The washing machine of claim 19, further comprising a wash plate adapter, wherein the wash plate adapter is positioned between the wash plate and the eccentric shaft, and is coupled to the wash plate and the eccentric shaft.

22. The washing machine of claim 19, further comprising a rotation preventing device configured to prevent rotation of the wash plate relative to the inner tub.

23. The washing machine of claim 22, wherein the rotation preventing device comprises a rotation preventing member mounted between the wash plate and the inner tub, the rotation preventing member having first guides extending in a first direction that interact with the wash plate, and second guides that extend in a second direction substantially perpendicular to the first direction, wherein the second guides interact with the inner tub.

24. A washing machine, comprising:

a wash shaft rotating by a rotational force transferred from a motor;

a wash plate configured to orbit about a rotational axis of the wash shaft to form a stream of water; and a movement converting unit coupled between the wash shaft and the wash plate and configured to convert a rotational movement of the wash shaft into an orbital movement of the wash plate, wherein the movement converting unit comprises:

a base having a central portion fixed to the wash shaft and having a peripheral portion;

an eccentric shaft coupled to the peripheral portion of the base such that a longitudinal axis of the eccentric shaft is parallel to and offset from the longitudinal axis of the wash shaft; and a counterweight mounted on one of the base and the wash plate and configured to correct an imbalance in the weights of the base and the wash plate.

* * * * *